US008763290B1

(12) United States Patent
Lin

(10) Patent No.: US 8,763,290 B1
(45) Date of Patent: Jul. 1, 2014

(54) WIND RESISTANT MODULE FOR ADVERTISEMENT CURTAIN

(71) Applicant: Ruei-Hsing Lin, New Taipei (TW)

(72) Inventor: Ruei-Hsing Lin, New Taipei (TW)

( * ) Notice: Subject to any disclaimer, the term of this patent is extended or adjusted under 35 U.S.C. 154(b) by 0 days.

(21) Appl. No.: 13/798,093

(22) Filed: Mar. 13, 2013

(51) Int. Cl.
*G09F 17/00* (2006.01)

(52) U.S. Cl.
USPC ..... 40/601; 40/602; 160/339

(58) Field of Classification Search
USPC ..... 40/601, 602, 603, 604; 160/338, 339, 160/329
IPC ..... G09F 17/00,2017/0041, 2017/0025
See application file for complete search history.

(56) References Cited

U.S. PATENT DOCUMENTS 2,910,121 A * 10/1959 Stern et al. ..... 160/125
7,121,029 B2 * 10/2006 Wilson ..... 40/601
7,614,172 B2 * 11/2009 Kennedy et al. ..... 40/604
8,505,163 B2 * 8/2013 Lin ..... 16/87.8
8,573,418 B2 * 11/2013 Lin ..... 211/180

* cited by examiner

*Primary Examiner* — David Purol
(74) *Attorney, Agent, or Firm* — Leong C. Lei

(57) ABSTRACT

A wind resistant module for advertisement curtain is movably mounted to a frame of an advertisement curtain to effectively cushion and counteract wind forces acting on the advertisement curtain and includes: a base, a board, a first resilient cushioning mechanism, and a second resilient cushioning mechanism. The base includes at least one group of rollers to allow the base to linearly move along the frame in a stable manner. The base is coupled, via the board, to the first resilient cushioning mechanism. The base is coupled externally with the second resilient cushioning mechanism. The first resilient cushioning mechanism provide a cushioning effect for the base against wind force in a longitudinal direction and the second resilient cushioning mechanism is coupled to the advertisement curtain to provide an cushioning effect for the advertisement curtain in a lateral direction and a frontward direction.

4 Claims, 5 Drawing Sheets

WIND RESISTANT MODULE FOR ADVERTISEMENT CURTAIN

TECHNICAL FIELD OF THE INVENTION

The present invention provides a wind resistant module for advertisement curtain and is particularly mounted, in a slidable manner, to a frame of an advertisement curtain with a group rollers contained in a base respectively coupled to corresponding rails of the frame so as to allow of linear movement of the base with respect to the frame of the advertisement curtain to be performed stably. Further, the base is coupled to a first resilient cushioning mechanism and a second resilient cushioning mechanism with the first resilient cushioning mechanism functioning to connect to a steel pull cable provided on the frame for positioning purposes thereby providing a cushioning effect against winds for sliding in a longitudinal direction (Y axis). The second resilient cushioning mechanism is coupled to the advertisement curtain to provide the entire advertisement curtain with cushioning effects against winds in a lateral direction (X axis) and a frontward direction (Z axis). When the advertisement curtain bears a high wind drag for winds acting on the advertisement curtain either on the front side or the rear side, the frame so connected is allowed to move downward due to the first resilient cushioning mechanism thereby effecting resistance against wind in the longitudinal direction (Y axis) so as to achieve cushioning and counteracting. Once the wind disappears, the frame so connected is allowed to move upward for returning due to the first resilient cushioning mechanism. As such, reciprocating displacement can be achieved to provide a mechanism for cushioning and counteracting wind drags.

Further, when the advertisement curtain receives wind drags in a lateral direction (X axis) or a frontward direction (Z axis), the second resilient cushioning mechanism may cushion and counteract the wind drags so as to alleviate the impact caused on the advertisement curtain by winds in different directions thereby improving the durability of the advertisement curtain against winds and reducing the burden of high expense for maintenance.

DESCRIPTION OF THE PRIOR ART

Advertisement is considered a way of public communication for achieving a specific goal by attracting the attention of people through transmitting language, characters, drawings, or images through mass communication media. With the rapid progress of industry and technology, various communication media are developed and consequently, more and more measures of advertisement are available, such as billboards erected on the tops of high buildings or attached to walls of buildings, built up in crossings or by traffic ways, shown in exhibition sites.

For medium or large sized advertisement curtains, besides the effect of being huge and impressed and serving as a mark when viewed from a distance, they surely provide the effectiveness of advertisement, particularly when built up on competition fields, exhibition sites, curtains, tops, outside walls of high or huge buildings. Besides being the most favored ways of advertisement, they are also the focuses of the attention and eyesight of general consumers. It can be said that the medium or large sized advertisement curtain is the best way that an advertisement can be put and is the key business opportunity that the advertisement business is seeking for and pursuing. However, the conventional large-sized advertisement curtain is generally composed of a skeleton that is constructed of a plurality of braces to form a configuration desired for a specific advertisement. Each brace has a slot (or slit). The advertisement curtain is provided with eyelets along edges thereof for connecting ropes that are fastened to the slots (or slits) of the braces in order to allow the large-sized advertisement curtain to be exhibited flat and secured on all the braces in a stretched and expanded manner.

Installation of such a medium or large size advertisement curtain is generally aloft operation and construction, such as on tops of high building or walls of large buildings. Extremely high wind drag is a common problem. In other words, the advertisement curtain must be tied to the slots (or slits) of the braces by ropes in order to stretch, expand, and fix the whole curtain. Such an operation is generally highly dangerous and time- and labor-consuming. Particularly, the ropes are generally fixed once being tied, namely being incapable of rotating for changing direction or resiliently pulled. When the advertisement curtain is subject to impacts of high wind drags from different directions, the advertisement curtain will shake or vibrate due to the wind drags. Such shakes or vibrations may induce instantaneous reaction on the rope that stretches the rope with high tension. Once the tension acting on the rope is over large, the rope may get broken, leading to detachment and random swinging of the advertisement curtain, which are extremely dangerous. Further, the aloft operation of using ropes to secure the advertisement curtain will also lead to high difficult of subsequent maintenance so that besides the high dangers, the expense for maintenance will also be high.

Further, in practical applications, it has occurred that destructive power of high wind drag induced by strong winds is taken as planar wind drag by the curtain and transmitted to the whole skeleton. However, the conventional advertisement curtain and skeleton are generally of no buffering mechanism against wind drag. Consequently, the whole skeleton may be subjected to the risk of bending, deforming or falling due to the stress caused by the instantaneous destructive wind force thereby jeopardizing the whole structure of the medium or large size advertisement curtain and costing a huge loss of expenditure.

SUMMARY OF THE INVENTION

The primary object of the present invention is to disclose a wind resistant module for advertisement curtain, which is movably mounted to a frame of an advertisement curtain and comprises: a base, a board, a first resilient cushioning mechanism, and a second resilient cushioning mechanism, wherein the base comprises at least one group of rollers, which respectively correspond to and are coupled to rails mounted on the frame so as to allow the base to linearly move up and down along the frame in a stable manner. The base is coupled to a board, which extends externally of the base to connect a first resilient cushioning mechanism. The first resilient cushioning mechanism comprises pulleys, which is coupled to a steel pull cable of a pulley set that is provided on the frame so that the base is driven and positioned by the steel pull cable to enable the base to do up and down sliding with respect to the frame. The base is provided externally with a second resilient cushioning mechanism coupled thereto. As such, the first resilient cushioning mechanism is connected to the steel pull cable provided on the frame for positioning purposes and providing a cushioning effect to the base for sliding motion in a longitudinal direction (Y axis). The second resilient cushioning mechanism is connected to the advertisement curtain to provide the advertisement curtain with a cushioning effect for displacement in a lateral direction (X axis) and a frontward direction (Z axis). Thus, when a strong wind or powerful wind instantaneously impacts the advertisement curtain, the advertisement curtain receives the wind forces, causing the frame to move downward due to the first resilient cushioning mechanism to effect resistance against wind in the longitudinal direction (Y axis), thereby achieving an effect of cushioning and counteracting. When winds are applied to induce wind forces in the lateral direction (X axis) or the frontward direction (Z axis), the second resilient cushioning mechanism operates to provide cushioning and counteracting. As such, alleviation of impact caused on the advertisement curtain by winds in different directions can be achieved to completely eliminate the potential risk of strong winds or powerful winds damaging the medium or large size advertisement curtain and effectively enhance the durability of the advertisement curtain and lower down expense of maintenance.

A secondary object of the present invention is to disclose a wind resistant module for advertisement curtain, which further comprises: a connection element. The connection element is mounted to the board. The connection element allows of coupling with a connection frame to allow an operator to connect the frame of the advertisement curtain to a previously arranged connection frame, if desired, in order to constitute an advertisement curtain of a different type.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
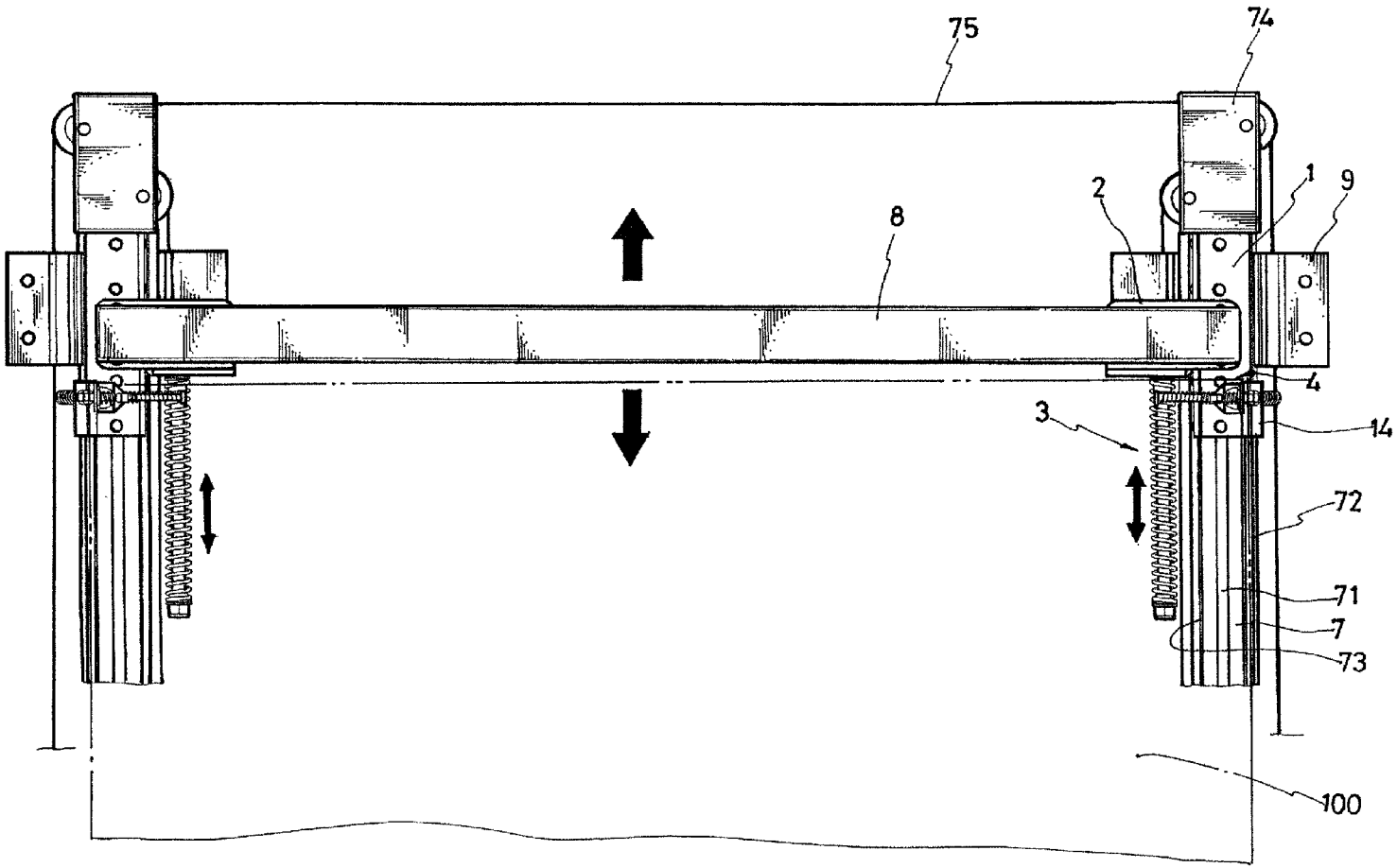
FIG. 1 is a schematic view showing an application of a wind resistant module for advertisement curtain according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, 4, and 5, the present invention discloses a wind resistant module for advertisement curtain, which is mounted, in a movable manner, on a frame 7 of advertisement curtain and comprise: a base 1, a board 2, a first resilient cushioning mechanism 3, a second resilient cushioning mechanism 4, and a connection element 5.

The base 1 is movably mounted to the frame 7. The base 1 comprises a first wall 11. The first wall 11 has opposite edges to which a second wall 12 and a third wall 13 that oppose each other are respectively mounted. The first wall 11, the second wall 12, and the third wall 13 collectively define an accommodation space 10. The base 1 comprises an extension section 14 that is located outside the accommodation space 10 and extending therefrom to provide an inclination surface. The extension section 14 comprises a first through hole 141. Further, the base 1 comprises one or more than one roller group 15 located in the accommodation space 10. The roller group 15 comprises: a first roller 151, a second roller 152, and a third roller 153. The first roller 151 is mounted to the first wall 11. The second roller 152 is mounted to the second wall 12. The third roller 153 is mounted to the third wall 13. Further, the base 1 comprises at least one first fastening hole 16.

The board 2 is mounted to the base 1 and located outside the accommodation space 10 and projects externally with respect to the base 1. Further, the board 2 is partially extended and bent to form a bent section 21. The bent section 21 comprises a second through hole 211. The second through hole 211 has an opening facing in a direction parallel to the base 1. Further, the board 2 comprises at least a second fastening hole 22 and a third fastening hole 23. As an example available for the preset invention, the board 2 is integrally formed with and thus fixed to the base 1. Alternatively, the second fastening hole 22 of the board 2 is set corresponding to the first fastening hole 16 of the base 1 and a fastening element 6 is used to fasten the first fastening hole 16 of the base 1 and the second fastening hole 22 of the board 2 together so as to securely fix the board 2 to the base 1.

The first resilient cushioning mechanism 3 is coupled to the second through hole 211 of the board 2 so that the first resilient cushioning mechanism 3 is substantially parallel to and opposes the base 1. The first resilient cushioning mechanism 3 comprises a positioning coupler 31, a first pulley 32, a first bar 33, a first elastic element 34, and a first stop element 35. The first bar 33 extends through the second through hole 211 of the board 2. The first bar 33 has opposite ends to which the positioning coupler 31 and the first stop element 35 are respectively coupled. The first bar 33 is received through the first elastic element 34 between the second through hole 211 and the first stop element 35. The positioning coupler 31 is rotatably coupled to the first pulley 32. As an example available in the present invention, the positioning coupler 31 comprises a shaft hole 311 and a shaft 312 associated with the shaft hole 311. The shaft 312 is received through the first pulley 32 and the shaft hole 311, so that the first pulley 32 is rotatably mounted to the positioning coupler 31. Further, the positioning coupler 31 comprises a connection sleeve 313 and is connected by the connection sleeve 313 to the first bar 33.

The second resilient cushioning mechanism 4 is coupled to the first through hole 141 of the extension section 14 of the base 1. The second resilient cushioning mechanism 4 comprises: a pawl 41, a second bar 42, a third bar 43, a second elastic element 44, and a third elastic element 45. The second bar 42 is rotatably coupled to the third bar 43. The second bar 42 extends through the pawl 41 and the third bar 43 extends through the first through hole 141. The second bar 42 has an end to which a second stop element 421 is mounted. The third bar 43 has an end to which a third stop element 431 is mounted. The second bar 42 is received in the second elastic element 44 between the pawl 41 and the second stop element 421. The third bar 43 is received in the third elastic element 45 between the first through hole 141 and the third stop element 431.

The frame 7 comprises a first rail 71, a second rail 72, and a third rail 73, which are respectively corresponding to the first roller 151, the second roller 152, and the third roller 153 of the base 1, whereby the first roller 151, the second roller 152, and the third roller 153 of the base 1 are respectively installed in the first rail 71, the second rail 72, and the third rail 73 of the frame 7. With a three-point support provided by the first roller 151, the second roller 152, and the third roller 153, the base 1 can be linearly movable along the frame 7 in a stable manner. Further, the frame 7 is provided with a pulley set 74 and a steel pull cable 75. The steel pull cable 75 is coupled to the first pulley 32 of the first resilient cushioning mechanism 3. Further, the frame 7 is coupled to a fixing rack 9, so that the frame 7 can be fixed to a predetermined object (such as building wall) by the fixing rack 9.

Two of the wind resistant module for advertisement curtains according to the present invention can be used together as a group to be respectively coupled to two frames 7 (as shown in FIG. 1) with the bases 1 thereof mounted a top portion of a bottom portion of the frames 7 as desired.

In an example of the present invention, the first pulley 32 of the first resilient cushioning mechanism 3 is coupled to the steel pull cable 75 of the frame 7, whereby when the steel pull cable 75 is pulled, the base 1, in entirety, is driven to move upward/downward along the frame 7. The pawl 41 of the second resilient cushioning mechanism 4 can be used to hook an eyelet or to tie a rope of an advertisement curtain 100 so that an operator only needs to stand on the ground and pull upward the steel pull cable 75 to move the base 1 up to a desired height and consequently, the entire advertisement curtain 100 is lifted to the predetermined height. This completely eliminate aloft operation of installation and climbing thereby overcoming the difficult and high risk of operation.

It is noted that when the first pulley 32 of the first resilient cushioning mechanism 3 is pulled by the steel pull cable 75 to raise to the predetermined height, the first pulley 32 may then serve as high fixed point, whereby with a cushioning effect provided by the first elastic element 34 of the first resilient cushioning mechanism 3, the base 1 may cause, via the board 2, compression of the first elastic element 34 so as to provide limited movability to the base 1.

As an example of the present invention, the first elastic element 34 of the first resilient cushioning mechanism 3 can be set in a longitudinal direction (Y axis) and the second elastic element 44 and the third elastic element 45 of the second resilient cushioning mechanism 4 are respectively set in a lateral direction (X axis) and a frontward direction (Z axis) so that the first resilient cushioning mechanism 3 provides the base 1 with longitudinal direction (Y axis) cushioning for sliding motion and the second resilient cushioning mechanism 4 provides the advertisement curtain with lateral direction (X axis) and frontward direction (Z axis) cushioning for displacement. When wind forces from different direction act on the advertisement curtain 100, forces in the longitudinal direction (Y axis) of the advertisement curtain 100 can be cushioned and counteracted by the first resilient cushioning mechanism 3 and forces in the lateral direction (X axis) and frontward direction (Z axis) of the advertisement curtain 100 can be cushioned and counteracted by the second resilient cushioning mechanism 4 so that the impact acting on the advertisement curtain 100 by winds in different directions can be lowered.

Figure 2:
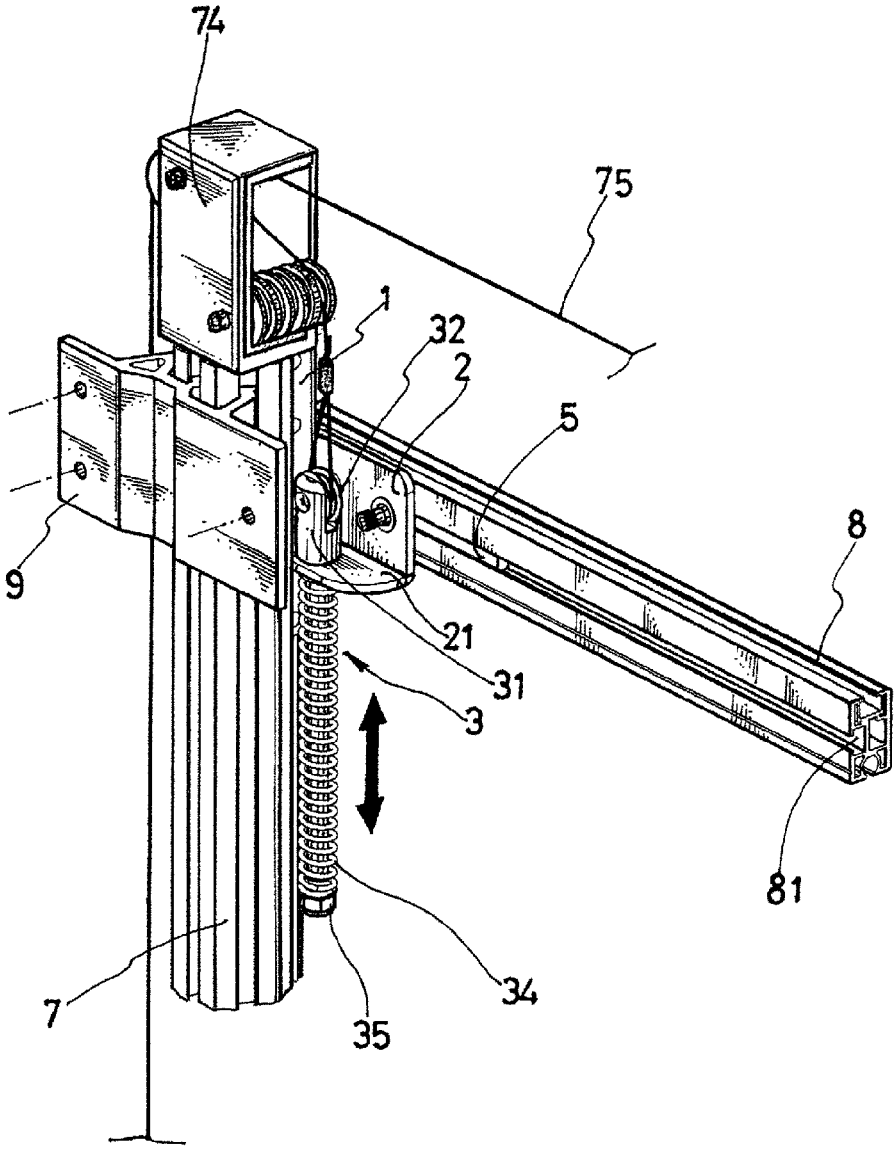
FIG. 2 is a partially perspective view showing the application of the wind resistant module for advertisement curtain according to the present invention, taken from a different viewing angle.
Figure 3:
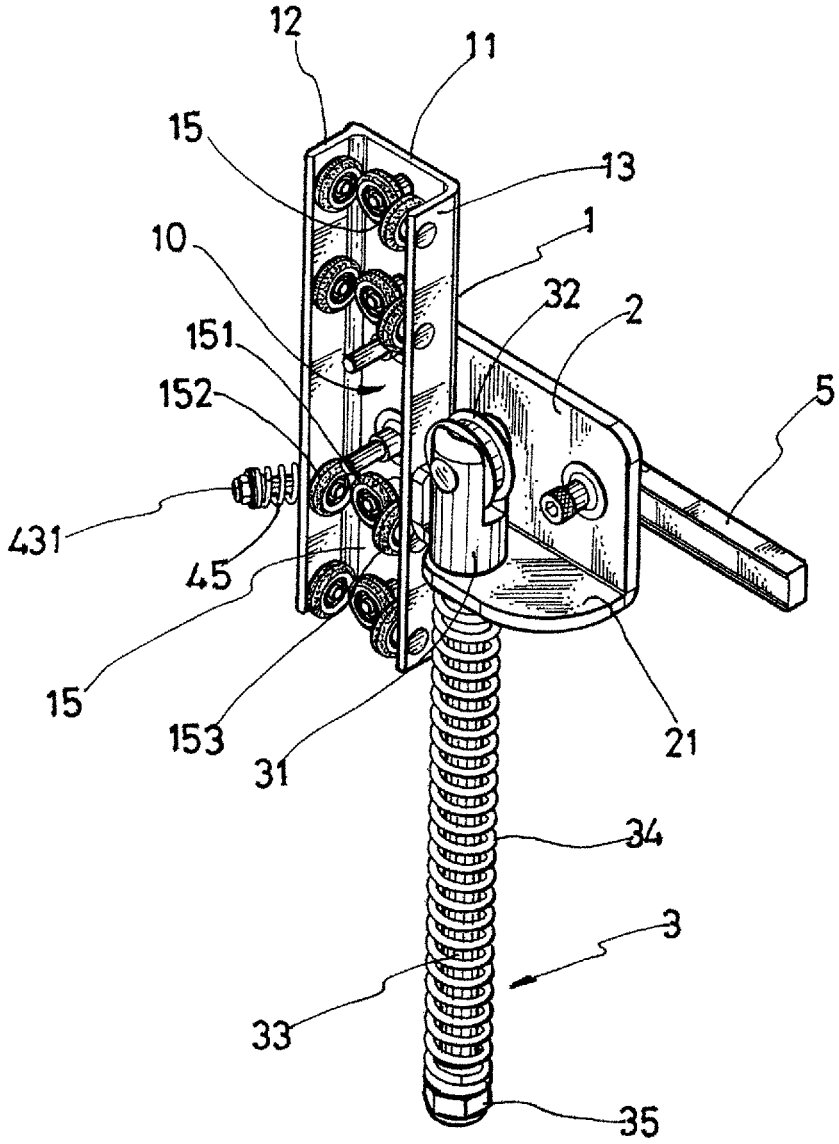
FIG. 3 is a perspective view of the wind resistant module for advertisement curtain according to the present invention.
Figure 4:
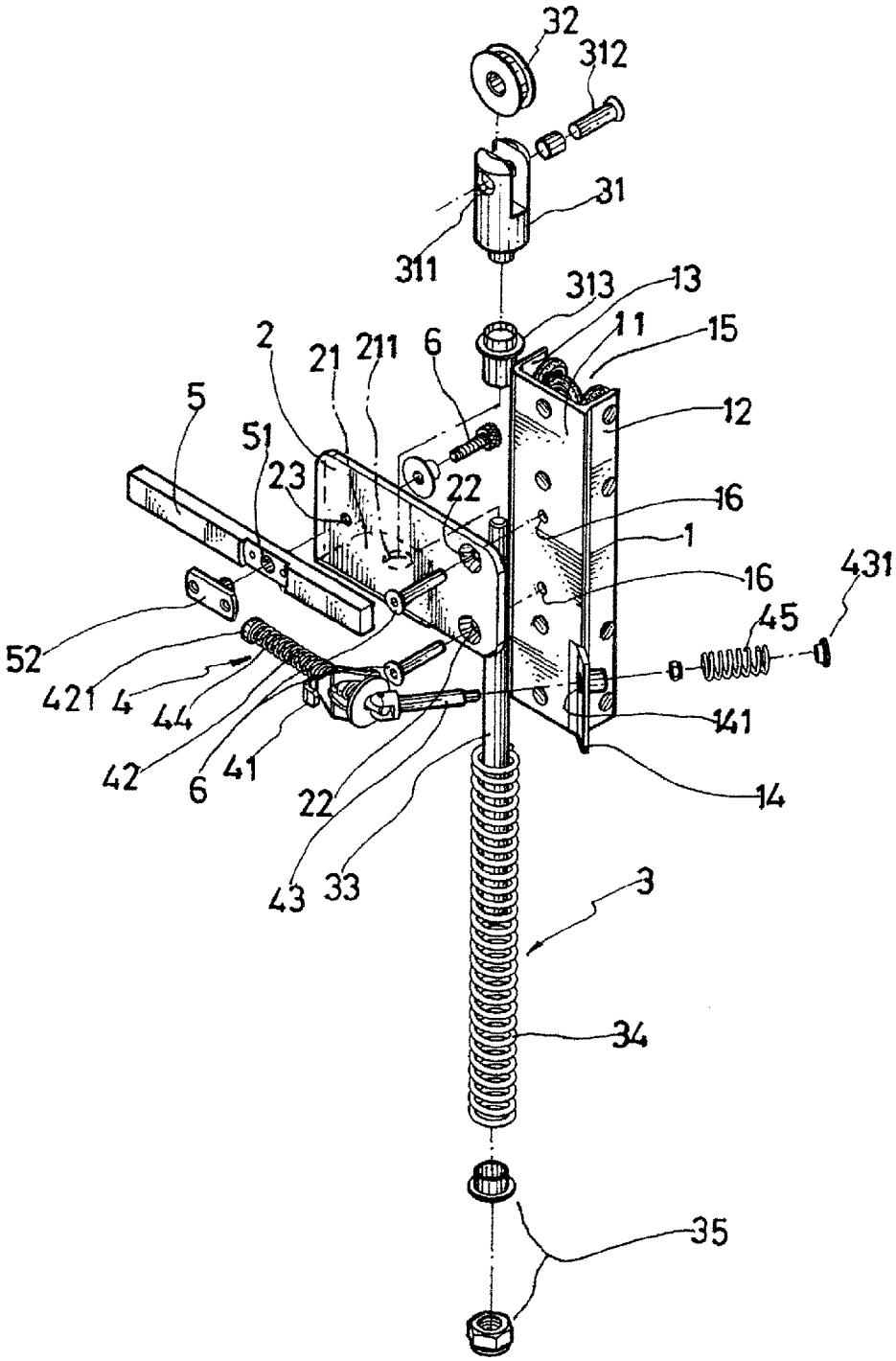
FIG. 4 is an exploded view of the wind resistant module for advertisement curtain according to the present invention take from a different viewing angle.
Figure 5:
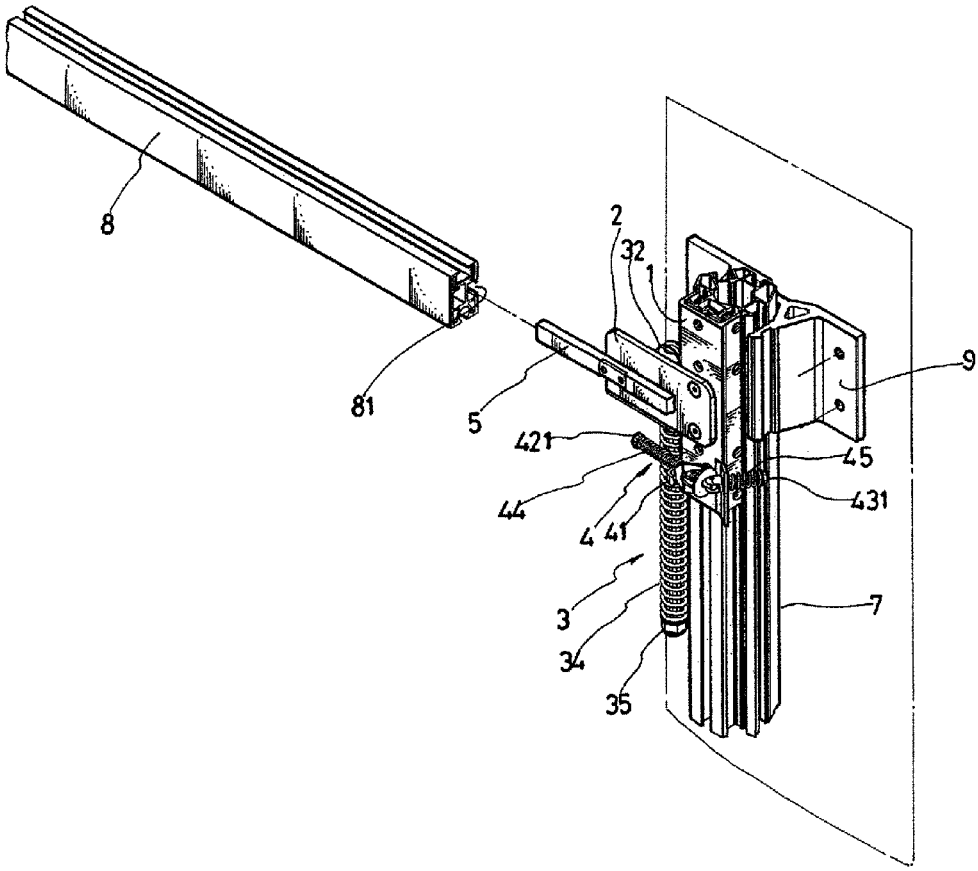
FIG. 5 is a schematic view illustrating an example of application of the wind resistant module for advertisement curtain according to the present invention.

The present invention further comprises: a connection element 5. The connection element 5 is coupled to the board 2. The connection element 5 comprises a fourth fastening hole 51 and a locking plate 52. The fourth fastening hole 51 corresponds to the third fastening hole 23 of the board 2 and a fastening element 6 is received through the third fastening hole 23 of the board 2 and the fourth fastening hole 51 of the connection element 5 and lockingly engages with the locking plate 52 so as to achieve fixing the connection element 5 to the board 2. The connection element 5 can be fit into and coupled to a coupling slot 81 formed in a connection frame 8. If desired, a user may connect the frame 7 to a previously set frame 8 (as shown in FIGS. 1, 2, and 5) to construct an advertisement curtain of a different type.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A wind resistant module for advertisement curtain, which is movably mounted to a frame for an advertisement curtain, the wind resistant module for advertisement curtain comprising:

a base, which is movably mounted to the frame, the base comprising a first wall, the first wall having opposite edges to which a second wall and a third wall that oppose each other are respectively mounted, the first wall, the second wall, and the third wall collectively defining an accommodation space, the base comprising at least one roller group arranged in the accommodation space, the roller group comprising a first roller, a second roller, and a third roller, the first roller being mounted to the first wall, the second roller being mounted to the second wall, the third roller being mounted to the third wall;

a board, which is mounted to the base and located outside the accommodation space, the board being extended to form a bent section, the bent section comprising a second through hole, the second through hole having an opening facing a direction substantially parallel to the base; and a first resilient cushioning mechanism, which is coupled to the second through hole of the board so that the first resilient cushioning mechanism is substantially parallel to and opposes the base, the first resilient cushioning mechanism comprising a positioning coupler, a first pulley, a first bar, a first elastic element, and a first stop element, the first bar extending through the second through hole, the first bar having opposite ends to which the positioning coupler and the first stop element are respectively coupled, the first bar being received through the first elastic element between the second through hole and the first stop element, the positioning coupler being rotatably coupled to the first pulley.

2. The wind resistant module for advertisement curtain according to claim 1 further comprising a second resilient cushioning mechanism, an extension section located outside and extending from the base, the extension section comprising a first through hole, the second resilient cushioning mechanism being coupled to the first through hole.

3. The wind resistant module for advertisement curtain according to claim 2, wherein the second resilient cushioning mechanism comprises a pawl, a second bar, a third bar, a second elastic element, and a third elastic element, the second bar being rotatably coupled to the third bar, the second bar extending through the pawl, the third bar extending through the first through hole, the second bar having an end to which a second stop element is mounted, the third bar having an end to which a third stop element is mounted, the second bar being received in the second elastic element between the pawl and the second stop element, the third bar being received in the third elastic element between the first through hole and the third stop element.

4. The wind resistant module for advertisement curtain according to claim 1 further comprising a connection element, which is mounted to the board.

* * * * *